United States Patent [19]

Krapf et al.

[11] Patent Number: 5,060,448

[45] Date of Patent: Oct. 29, 1991

[54] COMPOSITE LIGHTWEIGHT BEAM FOR A FREESTANDING DISPLAY OR THE LIKE

[75] Inventors: Wallace A. Krapf, Macedon; Robert J. Blood, Holcomb; Daniel W. Rossborough, Conesus, all of N.Y.

[73] Assignee: Krapf Business Systems, Inc., Macedon, N.Y.

[21] Appl. No.: 640,887

[22] Filed: Jan. 14, 1991

[51] Int. Cl.[5] ..... A47B 96/14

[52] U.S. Cl. ..... 52/732; 52/475

[58] Field of Search ..... 52/656, 475, 732, 239

[56] References Cited

U.S. PATENT DOCUMENTS 3,190,407 6/1965 Grisard et al. ..... 52/475

3,579,943 5/1971 Tam ..... 52/475

*Primary Examiner*—Richard E. Chilcot, Jr.

*Assistant Examiner*—Wynn Wood

*Attorney, Agent, or Firm*—Shlesinger, Fitzsimmons & Shlesinger

[57] ABSTRACT

A lightweight beam construction having a section formed of a pair of plates which are interconnectable between channel sections or useable alone. The central section includes reenforcing material such as corrugated honeycomb material extending between top and bottom plates, or the central section may include an H-beam reenforcing member extending between the side walls of the central section.

8 Claims, 2 Drawing Sheets

COMPOSITE LIGHTWEIGHT BEAM FOR A FREESTANDING DISPLAY OR THE LIKE

BACKGROUND OF THE INVENTION

In the field of lightweight beam construction, deflection of the beam tends to increase as the length of the span increases. In a freestanding display such as those commonly used for presentations, it is important that the frame supporting a display board be light enough to allow some degree of portability of the display. Achievement of the desired lightness can be achieved in part by the use of lightweight materials, such as aluminum, in the frame construction, and also through the use of box beams. The corollary to increased conservation of weight, however, is that the strength of the beam is, as a general rule, reduced. On the other hand, an increase in the strength of the beam usually results in a rather substantial increase in the cost of its manufacture.

For example, it is well known that extruded aluminum parts can be utilized in many instances to form structural beams which would be substantially lighter than corresponding steal beams, and yet would exhibit sufficient strength to form, for example, the frame for supporting a display board or the like. However, to extrude such a beam for large spans (say in the range of 6 to 10 feet with a cross section of approximately 6"×4") it would be necessary that the wall thickness of the extruded part be at least approximately 0.186".

Applicants, however, in an effort to reduce even further the weight and the cost of such a beam, have discovered a novel composite and/or modular aluminum extrusion beam which can be made substantially lighter and more inexpensively than beams of the type heretofore employed for constructing frames for display boards and the like.

In view of the foregoing, it can be seen that there is a need for an inexpensive, lightweight composite beam construction as herein described which will prevent any undesirable sagging of the beam over extended lengths thereof, and will thereby increase the stability of any freestanding display stands made therefrom, and thus will maintain the integrity and appearance of the freestanding display.

OBJECTS AND SUMMARY OF THE INVENTION

One of the most important objects of the disclosed invention is to provide a reenforced beam construction using composite beam technology.

Another object of the invention is to provide a composite beam construction using tongue-in-groove connectors to attach separate sections of the beam cross-section.

Yet another object of the present invention is to use lightweight honeycomb cell materials extending perpendicularly between a pair of opposite walls of a box beam to enhance rigidity and stability of the beam over extended lengths.

Yet another object of the invention is to reenforce the box beam using a reenforcing insert which forms an H-beam extending between two opposite walls of the box beam construction.

Still another object of the invention is to provide first and second U-shaped channel sections, with each of said channel sections having complimentary tongue or groove fasteners which are compatible with the other of the channel sections.

Still another object of the invention is a central section having a side wall having a tongue at one edge and a groove at the other edge for complimentary connection to the channel section to join the channel sections together.

In summary, therefore, the disclosed invention is directed to a lightweight beam construction having a box beam including a pair of U-shaped channel sections connectable to a central beam reenforcing section of selectable variable width and strength inducing properties. Depending on the length and desired weight of the beam, the central section may be formed of a pair of plates which are interconnectable between channel sections, or the central section may include honeycomb cell material extending between side walls of the box beam, or the central section may also include an H-beam reenforcing member extending between the side walls of the box beam.

The foregoing and other important objects of the invention will be apparent in view of the accompanying drawings and the following detailed description.

DETAILED DESCRIPTION OF THE INVENTION

Figure 1:
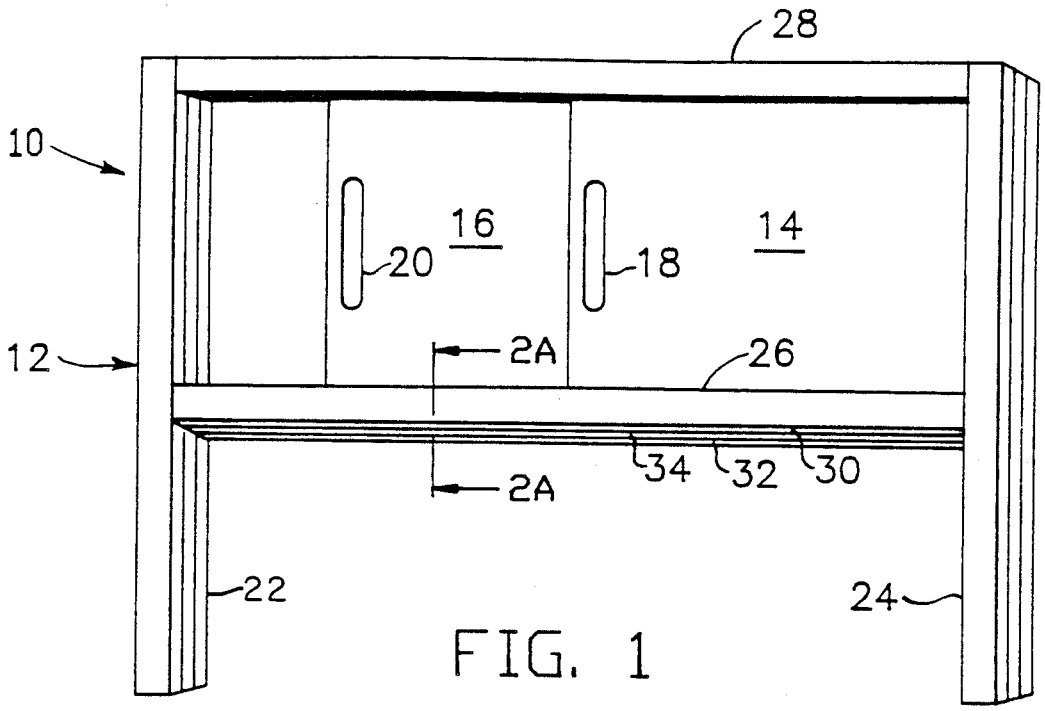
FIG. 1 is a perspective view of a freestanding display.

In FIG. 1, a freestanding display 10 is shown having a support frame 12 for supporting sliding display boards 14 and 16, respectively. Each display board 14 and 16 includes a handle 18 and 20, respectively for facilitating movement of the boards relative to the support frame 12 and to each other. The freestanding display 10 could also only have one board in a fixed position and could also have multiple display boards of four or more in number. Support frame 12 includes a pair of upstanding legs 22 and 24, respectively which are preferably, but not necessarily, of box beam construction. Joined substantially perpendicularly to and between legs 22 and 24 is a bottom horizontal beam 26 and a top horizontal beam 28. Legs 22 and 24 and beams 26 and 28 are all preferably formed by composite beam construction.

Beam 26 will be used as an example. Beam 26 uses a first channel section 30 and a second channel section 32 each being "U" shaped in cross-section. Channel sections 30 and 32 are joined by a central section 34.

While it is important that the bottom beam 26 and the top beam 28 be formed of composite construction for strength over extended spans, composite construction of legs 22 and 24 can sometimes be omitted, provided, however, that legs 22 and 24 remain equal to or wider than the width of the top and bottom beams. Since the height of the legs 22 and 24 occurs generally between about six and eight feet, the problem of deflection does not present a substantial problem. However, as the length of the beams 26 and 28 increase, the weight supported by legs 22 and 24 also increases. Therefore the use of similar sized central sections in the legs 22 and 24 to those used in beams 26 and 28 is desirable. It should also be noted that a uniform appearance enhances the impression of stability of the freestanding display 10 and can be achieved without substantial increases in weight affecting mobility of the freestanding display 10.

Figure 2A:
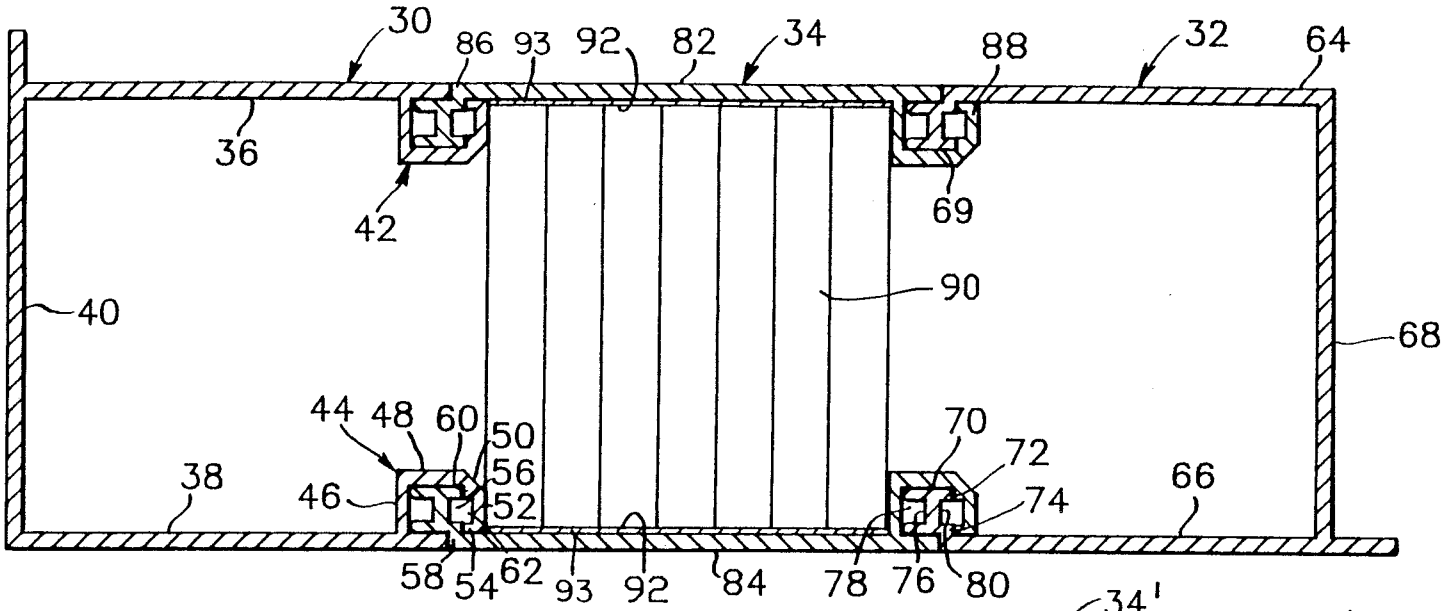
FIG. 2A is a cross-section of a beam of FIG. 1 taken along line 2A—2A of FIG. 1.

A cross-section of beam 26 taken along line 2A—2A in FIG. 1 is shown in FIG. 2A. First channel section 30 is shown having a top wall 36 and a bottom wall 38 and an end wall 40. All being formed of a unitary construction of preferably aluminum which is extruded to the desired shape. Each of top wall 36 and bottom wall 38 are shown in FIG. 2A as having a groove 42 and 44, respectively.

Now drawing attention to groove 44 to which groove 42 is substantially identical, groove 44 includes a wall 46 extending perpendicularly to bottom wall 38 and inwardly into channel section 30 about 0.23 inches. A wall 48 extends perpendicularly to wall 46 outwardly from channel section 30, a distance of about 0.25 inches. A wall 50 joins wall 48 at an angle of about 45° for a distance of about ⅛ of an inch. A wall 52 extends from wall 50 at an angle of 45° thereto and extends parallel in the opposite direction of wall 46, a distance of about 3/16ths of an inch and ends with a perpendicular hook section 54 extending perpendicularly therefrom towards wall 46, whereby a chamber or groove 44 is formed between the walls 38, 46, 48, 50, 52 and hook 54 leaving an opening 58 allowing entry into the groove 54. A nub 60 is formed on the interior side of wall 50. A U-shaped channel 62 is formed within chamber 56 between nub 60 and hook 54.

Second channel 32 includes a top wall 64 and a bottom wall 66 and an end wall 68. Top and bottom walls 64 and 66 include tongue sections 69 and 70, respectively, which are substantially identical. Tongue sections 69 and 70 are compatible with and slidable into grooves 42 and 44 respectively.

Tongue 70 includes an "I" shaped section having a pair of bars 72 and 74 extending parallel to bottom wall 66 with bars 72 and 74 being connected by connecting bar 76. Bars 72 and 74 together with connecting bar 76 form a pair of U-shaped channels 78 and 80. Channel 80 combines with channel 62 of the groove 44 to form a rectangular open box 81 into which a suitable fastening means may be inserted to rigidify the connection between a tongue and a corresponding groove, as shown for example in FIG. 3.

Central section 34 as shown in FIG. 2A includes top and bottom plates 82 and 84, respectively. Each plate 82 and 84 includes a tongue section 86 at one end and a groove section 88 at the other. Central section 34 includes a corrugated honeycombed reenforcing material 90 extending between top plate 82 and bottom plate 84. The preferred corrugated honeycombed material 90 is formed of kraft paper such as that commonly found in cardboard boxes. The honeycomb cell extends between and is fixed against movement relative to plates 82 and 84, thereby to provide an unexpectedly rigid central section. The honeycomb material 90 is covered by a thick paper or cardboard 92 on its faces extending between the corrugated material and top and bottom plates 82 and 84, and is securely joined to top and bottom plates 82 and 84 by suitable adhesive, such as a wet or contact adhesive, or a double-sided adhesive layer 93 which adheres the paper 92 to the plates 82 and 84.

It should be understood that the tongue and groove connectors can be alternated during manufacture for additional flexibility when the first channel section 30 and second channel section 32 and central section 34 are formed so that for example, the first channel section 30 may have either two grooves 42 and 44 as shown or could have two tongues or alternatively one tongue and one groove as long as the tongues and grooves correspond for a suitable connection between the central section 34 and a second channel section 32 having corresponding tongue and groove arrangements.

Figure 2B:
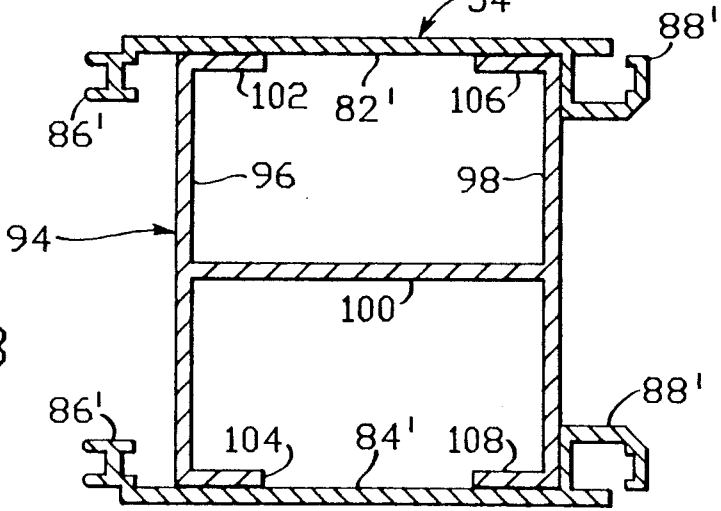
FIG. 2B is a cross-section of another embodiment of the central reenforcing section of FIG. 2A.

FIG. 2B shows an alternative embodiment of the reenforcing apparatus for the central section of FIG. 2A. Like parts of FIG. 2B to those of FIG. 2A will be referred to by like prime numbers. Central section 34' includes a top plate 82' and a bottom plate 84'. Each of the plates includes a tongue 86' and a groove 88'. Reenforcement of central section 34' is accomplished through the use of an H section 94 as shown. H section 94 will be preferably made of rigid material such as aluminum or rigid plastic. H section 94 includes a pair of walls 96 and 98 extending substantially perpendicularly between top plate 82' and bottom 84'. Walls 96 and 98 are joined by a central anti-buckling bar 100 which extends the length of the beam 26 and prevents flexure of the walls 96 and 98 when a load is applied to the beam 26'. Each of walls 96 and 98 includes top and bottom extensions 102, 104, 106 and 108, respectively, which extend parallel to anti-buckling bar 100 to provide additional rigidity to the central section 34' as well as to provide a fastening surface for adhering extensions 102, 104, 106 and 108 to plates 82' and 84'.

Figure 3:
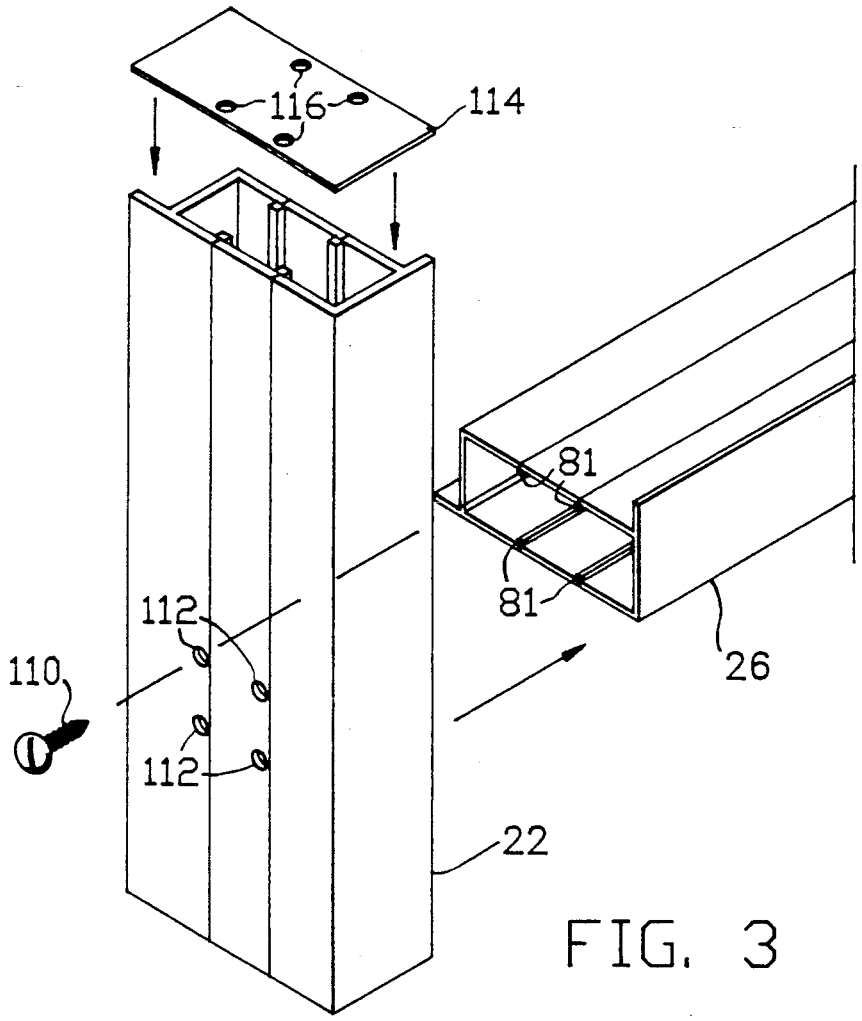
FIG. 3 is an exploded view of the leg to beam attachment.

FIG. 3 is an exploded view showing the connection between leg 22 and beam 26 which are joined by four fastening screws 110 which pass through holes 112 in leg 22 and join with the rectangular boxes 81 formed by channel 80 in the tongue 70 and channel 62 in groove 44 as previously described with respect to FIG. 2A.

Rigidity is added to leg 22 by adding an end cap or cover plate 114 having fastener-receiving holes 116 therein which correspond to the locations of the rectangular boxes 81 formed by the tongue 70 and groove 44 sections of leg 22. Rigidity is added to leg 24 in the same manner as described with respect to leg 22.

The opposite end of beam 26 is attached to leg 24 in the same manner as the attachment to leg 22. Beam 28 is attached to legs 22 and 24 in the same manner as beam 26. Leg 24 also includes an end cap or cover plate 114 fastened thereto for added rigidity.

While this invention has been described as having a composite lightweight beam for a freestanding display or the like, it is understood that it is capable of further modification, uses and/or adaptations of the invention and including such departures from the present disclosure as come within known or customary practice in the art to which the invention pertains, and as may be applied to the essential features set forth, and fall within the scope of the invention or the limits of the appended claims.

We claim:

1. A composite box beam, comprising a first channel section, a second channel section and an elongate central section, said central section comprising a pair of spaced, parallel plates having opposed, longitudinally extending side edges connected to said first and second channel sections, each of said first and second channel sections having attachment means thereon for connection with the longitudinal side edges of said central section, and said central section including reenforcing means extending between said spaced plates, said reenforcing means of said central section being formed of a honeycombed material.

2. The composite box beam of claim 4, wherein said honeycombed material is constructed of paper.

3. The composite box beam of claim 1, wherein said honeycombed material includes a plurality of open passages therein extending from one of said spaced plates to the other of said spaced plates.

4. A reenforcing beam for use with at least one other beam, said reenforcing beam includes a top member and a bottom member having thereon confronting surfaces spaced apart from and parallel to each other, said reenforcing beam includes a spacer located between the confronting surfaces on said top and bottom members and having a width and length equal to the width and length of said confronting surfaces on said top and bottom members, said spacing member includes a top and a bottom and has means for securing said top and bottom thereof to said confronting surfaces of said top and bottom members, and said spacer member comprises a series of interconnected corrugations arranged vertically between said confronting surfaces of said top and bottom members and constructed of a material of substantially less weight than that of said top and bottom members.

5. The reenforcing beam of claim 4, wherein said interconnected corrugations are formed of paper.

6. The reenforcing beam of claim 5, wherein said top and bottom members are formed of metal.

7. The reenforcing beam of claim 6, wherein said interconnected corrugations are joined to said confronting surfaces on said top and bottom members by an adhesive layer at each of said confronting surfaces.

8. In a freestanding display having a frame formed by a pair of vertically disposed legs secured to opposite ends of at least one box beam upon which is supported at least one display board, the improvement wherein said box beam comprises a pair of spaced, parallel, elongated metal plates forming the center section of the box beam, a pair of spaced, parallel, metal side sections secured by tongue and groove connections to the opposed side edges of said metal plates operatively to support said plates in spaced, parallel confronting relation to each other, and a reenforcing member secured to and extending in the space between said plates, said reenforcing member comprising a honeycombed material lighter in weight than the material from which said side sections and plates are made, and being secured at opposite sides thereof to the confronting surfaces of said plates.

* * * * *